United States Patent [19]

Finn

[11] Patent Number: 4,516,615

[45] Date of Patent: May 14, 1985

[54] TOOL HANDLE ATTACHMENT

[75] Inventor: Arnold H. Finn, Farmington, Conn.

[73] Assignee: Taco Products, Incorporated, Plainville, Conn.

[21] Appl. No.: 353,357

[22] Filed: Mar. 1, 1982

[51] Int. Cl.[3] ..... B25C 1/00

[52] U.S. Cl. ..... 81/20; 403/266; 403/267

[58] Field of Search ..... 145/29 R, 36; 403/266, 403/267

[56] References Cited

U.S. PATENT DOCUMENTS

| | | | |
|---|---|---|---|
| 255,166 | 3/1882 | Hardie | 145/29 R |
| 2,678,853 | 5/1954 | Reeder | 145/29 R |
| 3,172,708 | 3/1965 | Reuterfors | 145/29 R |
| 3,792,725 | 2/1974 | Burgeson | 145/36 |
| 3,819,288 | 6/1974 | Carmien | 145/36 |
| 4,085,784 | 4/1978 | Fish | 145/29 R |

*Primary Examiner*—Frederick R. Schmidt
*Assistant Examiner*—J. T. Zatarga
*Attorney, Agent, or Firm*—McCormick, Paulding & Huber

[57] ABSTRACT

The handle of a maul is attached to the head of the tool within an eye in the head. A U-shaped retaining member straddles a connecting portion of the handle within the eye. The space within the eye between the handle and the head is filled with epoxy cement in which the retaining member is embedded. The retaining member coacts with the handle and the head to increase retaining force therebetween when pull-off force is applied to separate the handle from the head.

12 Claims, 8 Drawing Figures

TOOL HANDLE ATTACHMENT

BACKGROUND OF THE INVENTION

This invention relates in general to tool handle joints or attachments and deals more particularly with a device and method for securing a handle in assembly within the eye of a tool head. The attachment and method of the present invention are particularly adapted for use in the manufacture of impact tools such as hammers, mauls, axes, sledges and the like. Methods have been developed for the manufacture of impact tools which utilize epoxy resin retention compounds for securing handles to the heads of such tools. While such epoxy cements generally provide joints having great structural integrity and a high degree of reliability, such joints do occasionally fail, particularly when a tool is improperly used or abused.

It is the general aim of the present invention to provide an improved tool handle attachment and a retaining device for use in making the attachment and which may be used in conjunction with a retaining compound, such as an epoxy cement, to secure a handle in the eye of a tool head.

SUMMARY OF THE INVENTION

The present invention relates to a tool having a head including an eye and an elongated handle having a grip portion and a connecting portion longitudinally spaced from the grip portion and disposed within the eye. In accordance with the invention, a retaining member has a first portion engaged with the connecting portion and a second portion which extends laterally outward from the first portion. The second portion of the retaining member has an outer end preferably for engaging the head within the eye. The retaining member coacts in wedging relation with the connecting portion and the head for increasing resistance to separation of the head from the handle in response to pull-off force tending to effect such separation.

DETAILED DESCRIPTION OF PREFERRED EMBODIMENT AND METHOD

Figure 1:
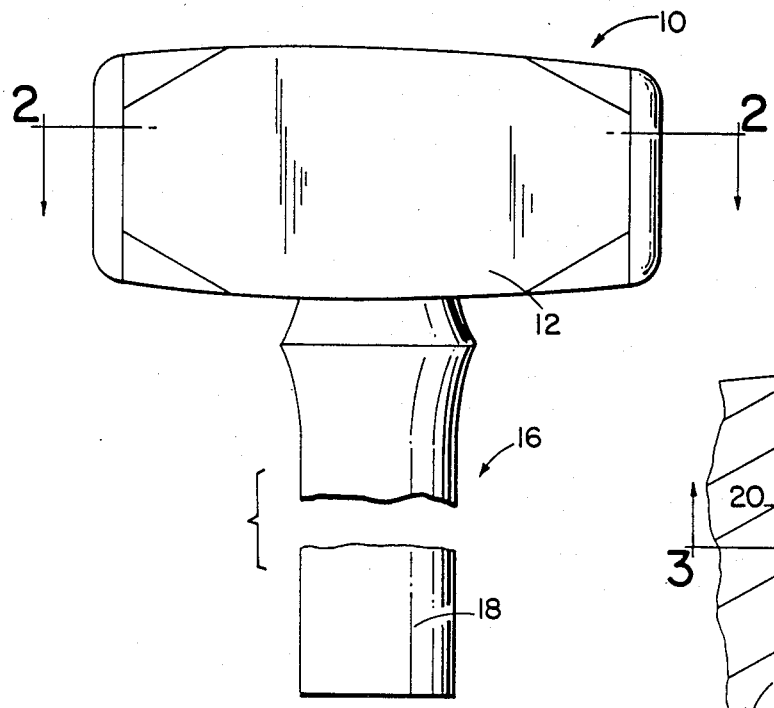
FIG. 1 is a fragmentary side elevational view of a maul having a handle attachment embodying the present invention and made in accordance with the method of the invention.
Figure 2:
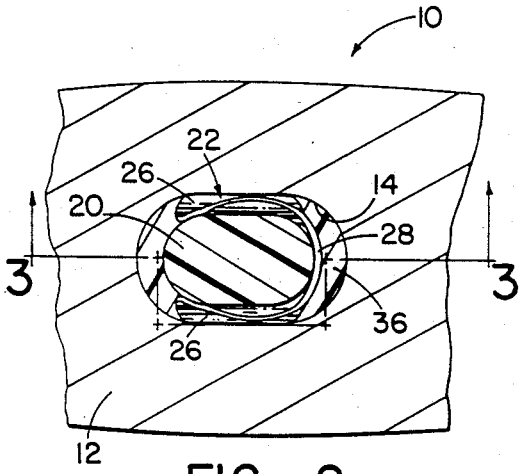
FIG. 2 is a somewhat enlarged fragmentary sectional view taken along the line 2—2 of FIG. 1.
Figure 3:
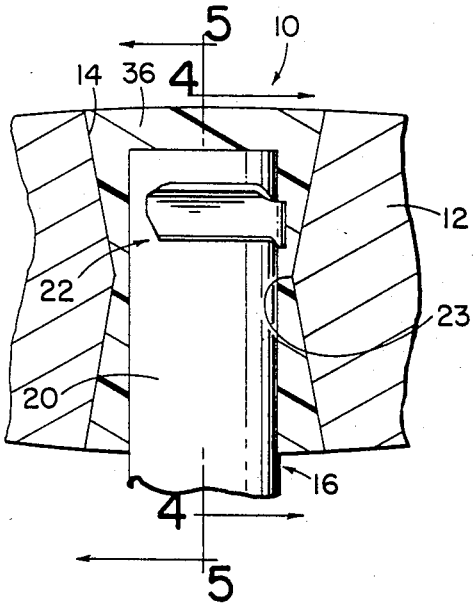
FIG. 3 is a sectional view taken along the line 3—3 of FIG. 2.

Turning now to the drawing, a maul having a handle joint or attachment embodying the invention and made in accordance with the invention is indicated generally by the reference numeral 10. The maul 10 has a generally conventional outward appearance and includes a solid head 12, which has an eye 14, and an elongated handle, indicated generally at 16, which includes a grip portion 18 and a connecting portion 20. The connecting portion is disposed within the eye 14. In accordance with the broad concept of the invention, a retaining member indicated generally by the numeral 22 is disposed within the eye 14 and has a first portion engaged with the handle connecting portion 20. A second portion of the retaining member is inclined laterally outwardly from the connecting member and in the direction of the grip portion 18 preferably for engaging the head 12 within its eye 14. The retaining member 22 coacts with the head 12 and the handle 16 to exert an inwardly directed wedging force on the handle connecting portion 20 when pull-off force is exerted upon the head in a generally longitudinal direction and away from the grip portion 18, as will occur when the maul is swung to strike a blow. The retaining member 22 may secure the handle 16 to the head 12, but preferably, and as shown, the space within the eye 14 between the head 12 and the connecting portion 20 is filled with a retaining compound, such as an epoxy cement, which tenatiously adheres to both the connecting portion and the head. The retaining member 22 is embedded within the retaining compound.

Figure 6:
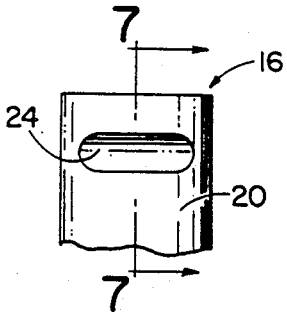
FIG. 6 is a fragmentary side elevational view of the connecting portion of the maul handle.
Figure 7:
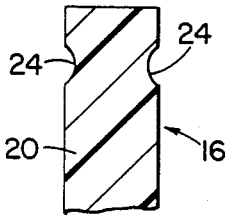
FIG. 7 is a fragmentary sectional view taken along the line 7—7 of FIG. 6.

The shape of the eye may vary, however, in the illustrated maul 10 the eye 14 has a generally hourglass shape and tapers inwardly from its opposite ends to a central waist 23, which defines the minor cross-sectional area of the eye. The handle 16 may be made from any suitable material, but preferably, and as shown, it is made from a plastic material such as fiberglass. The cross sectional area of the handle connecting portion 20 is somewhat smaller than the cross sectional area of the eye 14 at its waist. Laterally outwardly opening grooves 24, 24 are preferably formed in opposite sides of the connecting portion 20 and extend transversely of the handle 16, as best shown in FIGS. 6 and 7. Preferably, and as best shown in FIG. 7, each groove 24 has a generally arcuate or parti-circular cross-section, for a purpose which will be hereinafter further discussed.

Figure 4:
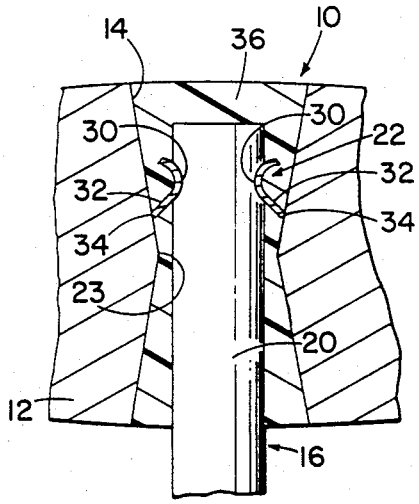
FIG. 4 is a sectional view taken along the line 4—4 of FIG. 3.
Figure 5:
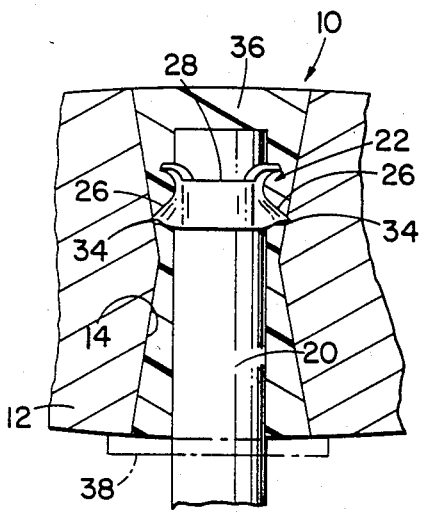
FIG. 5 is a sectional view taken along the line 5—5 of FIG. 3.
Figure 8:
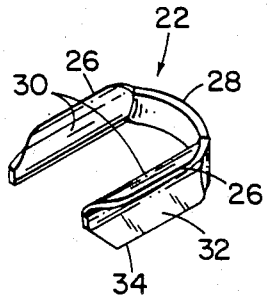
FIG. 8 is a somewhat enlarged perspective view of the retaining member.

Considering now the retaining member in further detail, the illustrated retaining member 22 is preferably formed from flat metal and comprises a generally U-shaped element adapted to straddle the connecting portion 20 and engage the connecting portion within the grooves 24, 24. The retaining member 22 has two parallel parts or legs 26, 26 integrally joined by an intermediate part designated by the numeral 28. An elongated first portion of each leg is received within an associated groove 24 and is shaped to generally complement the arcuate cross-section of the groove. The elongated first portions of the legs 26, 26 are indicated at 30, 30 and best shown in FIGS. 4 and 8. Each leg also has an elongated second portion 32 which is integrally connected to an associated first portion 30 and which extends laterally outward from the first portion and toward the head 12. More specifically, the second portion 32 of each leg is inclined outwardly from the handle connecting portion 20 and in the direction of the handle grip portion 18. Each second portion 32 terminates at an outer end which defines an elongated relatively sharp incising edge 34, which is preferably adapted to incise or otherwise dig into the head in response to pull-off force. The edge 34 extends in a transverse direction relative to the handle 16 when the retaining member is attached, in its straddling position, to the connecting portion of the handle. The retaining member 22 is preferably dimensioned for force fit within the eye so that the incising edges 34, 34 engage associated walls of the eye 14 when the connecting portion 20 and the retaining member 22 are positioned within the eye 14. The retaining member is preferably assembled with the handle before being forcably inserted into the eye 14. In assembly, the retaining member 22 is preferably engaged with the head 12 within the eye 14 at the opposite side of the waist 23 from the handle grip portion 18.

When the connecting portion 20 and the retaining member 22 are properly positioned within the eye 14, a quantity of retaining compound or epoxy cement, indicated by the numeral 36, is poured into the eye to fill at least the space within the eye between the retaining member 22 and the grip portion of the handle, but preferably the entire space within the eye between the head 12 and the connecting portion 20 is filled to embed the retaining member 22. This operation may be readily performed by providing a temporary sealing gasket, such as indicated by broken lines at 38, and arranging the gasket to surround an associated part of the handle 16 adjacent the head 12, to form a temporary seal at the handle end of the eye 14. The maul is then supported with the handle 16 in a depending position, as it appears in FIG. 1, after which the retaining compound is poured into the eye through its upper end and flows around the retaining member to substantially fill all of the space within the eye. The assembly is completed by curing the retaining compound and removing the temporary sealing gasket 36.

The epoxy retaining compound will tenaciously adhere to both the head 12 and the handle 16. Further, the generally hourglass shape of the eye 14 serves to lock the epoxy compound 36 within the eye so that separation is not likely to occur between the head 12 and the epoxy compound. Should separation occur between the handle connecting portion 20 and the epoxy compound 36, resulting from pull-off force, the epoxy compound will coact with the outwardly flared second portions 32, 32 of the legs 26, 26 causing the legs to coact in wedging engagement with the connecting portion of the handle whereby to increase the retaining force applied to the handle by the retaining member 22. More specifically, movement of the head 12 in a separation direction away from the handle 16 will cause the retaining compound 36 to exert force on the laterally outwardly extending second portions 32, 32 causing the legs 26, 26 to twist relative to the intermediate part 28 and pivot within the grooves 24, 24 so that in the preferred embodiment the incising edges 34, 34 tend to dig into and firmly grip the head 12. The leg first portions 30, 30 will, in turn, move toward each other and into tightly gripping engagement with opposite sides of the connection portion 20 within the grooves 24, 24. Thus, it will be apparent that the retaining member 22, when used in conjunction with an epoxy retaining compound or the like, will result in a handle attachment having great structural integrity and a high degree of reliability.

I claim:

1. In a tool having a head including an eye, an elongated handle having a grip portion and a connecting portion longitudinally spaced from the grip portion and disposed within the eye, and retaining means for securing the connecting portion to the head, the improvement wherein said retaining means comprises a generally U-shaped metal retaining clip disposed within said eye between said connecting portion and said head and having transversely extending legs straddling said connecting portion, at least one of said legs having a transversely extending first portion engaged with said connecting portion and a transversely extending second portion integrally joined to said first portion and inclined in a longitudinal direction laterally outwardly and away from the surface of connecting portion and toward said grip portion, said second portion cooperating with an associated portion of said surface to define a generally wedge shaped space therebetween, said second portion terminating at an outer end laterally spaced from the surface of said connecting portion and engaging said head within said eye, said retaining clip coacting in wedging relation with said connecting portion and said head to increase resistance to separation between said handle and said head in response to pull-off force tending to effect said separation.

2. In a tool as set forth in claim 1 the further improvement wherein said connecting portion has at least one laterally outwardly opening groove and said first portion is disposed within said one groove.

3. In a tool as set forth in claim 1 the further improvement wherein said outer end defines an incising edge.

4. In a tool as set forth in any one of claims 1 2 and 3 the further improvement wherein said handle is made from fiberglass.

5. In a tool having a head including an eye, an elongated handle having a grip portion and a connecting portion longitudinally spaced from the grip portion and disposed within the eye, the eye having a taper converging toward said grip portion, the connecting portion having transversely extending and laterally outwardly opening grooves in opposite sides thereof, and retaining compound within said eye between said head and said connecting portion, the improvement comprising a generally U-shaped retaining member embedded within said compound and straddling said connecting portion, said retaining member having a pair of transversely extending generally parallel laterally spaced apart legs and an intermediate part integrally connected to one end of each of said legs and extending generally laterally therebetween, each of said legs having a transversely extending first portion disposed within an associated one of said grooves and a transversely extending second portion longitudinally inclined outwardly from said first portion and toward said grip portion, said second portion having an inner surface inclined laterally outwardly and away from an associated surface of said connecting portion and cooperating with said associated surface to define a generally wedge-shaped space between said inner surface and said associated surface, said second portion terminating at an end portion having a generally transversely extending edge disposed in general engagement with said head within said eye, and a quantity of said retaining compound disposed within said eye between said retaining member and said grip portion and adhering to said head and said connecting portion, said retaining compound substantially filling said wedge-shaped space and cooperating with said retaining member upon the occurence of separation between said connecting portion and said retaining compound in response to pulloff force to urge each said end portion laterally outwardly away from said connecting portion to increase gripping engagement of said end portion with said head.

6. In a tool as set forth in claim 5 the further improvement wherein each said end portion defines a transversely extending incising edge.

7. In a tool as set forth in either claim 5 or 6 the further improvement wherein each groove has a generally arcuate cross-section and each said first portion is received within and generally complements said associated groove.

8. In a tool as set forth in claim 5 the further improvement wherein the major lateral dimension of said retaining member is slightly greater than the lateral dimension of an associated portion of said eye whereby said retaining member is received in force fit assembly with said head within said eye.

9. In a tool as set forth in claim 8 the further improvement wherein said eye has a generally hourglass configuration including a waist portion defining the minor cross-sectional area of said eye.

10. In a tool as set forth in claim 9 the further improvement wherein said retaining member is engaged with said head within said eye at the opposite side of said waist portion from said grip portion.

11. In a tool as set forth in any one of claims 1, 2 and 3 including a quantity of retaining compound disposed within said eye and filling at least a portion of said eye between said retaining member and said grip portion and substantially filling said wedge-shaped space, said retaining compound being adheared to said connecting portion and said head.

12. In a tool as set forth in claim 11 the further improvement wherein said retaining compound comprises an epoxy resin.

* * * * *